US005176539A

United States Patent [19]

Liu

[11] Patent Number: 5,176,539

[45] Date of Patent: Jan. 5, 1993

[54] SAFETY PLUG

[76] Inventor: Louis Liu, Ta Tsun Shiang, No. 74, Lane 6, Sec. 1, Chung Shan Rd., Chang Hua, Taiwan

[21] Appl. No.: 853,581

[22] Filed: Mar. 18, 1992

[51] Int. Cl.[5] ..... H01R 13/68

[52] U.S. Cl. ..... 439/622; 337/198

[58] Field of Search ..... 439/621, 622; 337/198, 337/197

[56] References Cited

U.S. PATENT DOCUMENTS 2,225,718 12/1940 Sheppley et al. ..... 337/198

3,436,711 4/1969 Borzoni ..... 337/198

FOREIGN PATENT DOCUMENTS 1173785 3/1959 France ..... 337/198

*Primary Examiner*—Gary F. Paumen

*Attorney, Agent, or Firm*—Bacon & Thomas

[57] ABSTRACT

A safety plug comprising a plastic casing having two separate wire holes for inserting the positive and negative conductors of an electric wire and a chamber on a top edge thereof covered by a cover, said chamber having a first female projection and a second female projection connected by a fuse, said cover having two male projections respectively inserted into holes on said first and second female projections to secure said fuse in place, wherein the positive plug pin is connected to said first female projection, the negative plug pin is directly connected to the negative conductor of said electric wire, and the positive conductor of said electric wire is connected to said second female projection. The fuse is burnt out to cut off the circuit upon overload on the electric wire.

2 Claims, 2 Drawing Sheets

SAFETY PLUG

BACKGROUND OF THE INVENTION

1. Field of the Invention

The present invention relates to electrical plugs and relates more particularly to an electrical safety plug which has a positive plug pin connected to the positive conductor of an electric wire by a fuse.

2. Description of Prior Art

The plastic casing of an electrical plug simply has a single wire hole for inserting the positive and negative conductors A1, A2 of an electric wire which are to be connected to the positive and negative plug pins B1, B2 (see FIG. 1). Before inserting the electric wire into the wire hole on the plastic casing for connection to the plug pins, the two conductors A1, A2 (with their insulators) must be separated at a certain length for convenient installation. When the two separated conductors A1, A2 are inserted into the single wire hole on the plastic casing and connected to the two plug pins respectively, they are loosely retained in the wire hole. Because the two conductors A1, A2 are directly connected to the two plug pins, an electric appliance to which an electric power supply is connected by the electrical plug may be burnt out in case of overload. The present invention has been accomplished to eliminate these problems.

SUMMARY OF THE INVENTION

According to one aspect of the present invention, a safety plug comprises a chamber on the plastic casing thereof covered by a cover, which cover has two male projections respectively inserted in two female projections in the chamber to secure a fuse therebetween, wherein the positive plug pin is connected to one female projection, the negative plug pin is directly connected to the negative conductor of an electric wire, and the positive conductor of such electric wire is connected to the other female projection, and therefore the fuse is burnt out to cut off the circuit upon overload on the electric wire.

According to another aspect of the present invention, the positive plug pin has a flat connecting end at one end of the pin body thereof, which flat connecting end has a hole thereon and is longitudinally aligned with and perpendicular to the pin body for easy connection to the female projection.

According to still another aspect of the present invention, the cover can be conveniently opened and closed again so that the fuse can be replaced easily when burnt out.

According to still another aspect of the present invention, the plastic casing has two separate wire holes for inserting the positive and negative conductors of the electric wire conveniently.

BRIEF DESCRIPTION OF THE DRAWINGS

The foregoing and other objects, features and advantages of the present invention will be best understood from the following description, the appended claims and the accompanying drawings in which:

DETAILED DESCRIPTION OF THE PREFERRED EMBODIMENT

Figure 2:
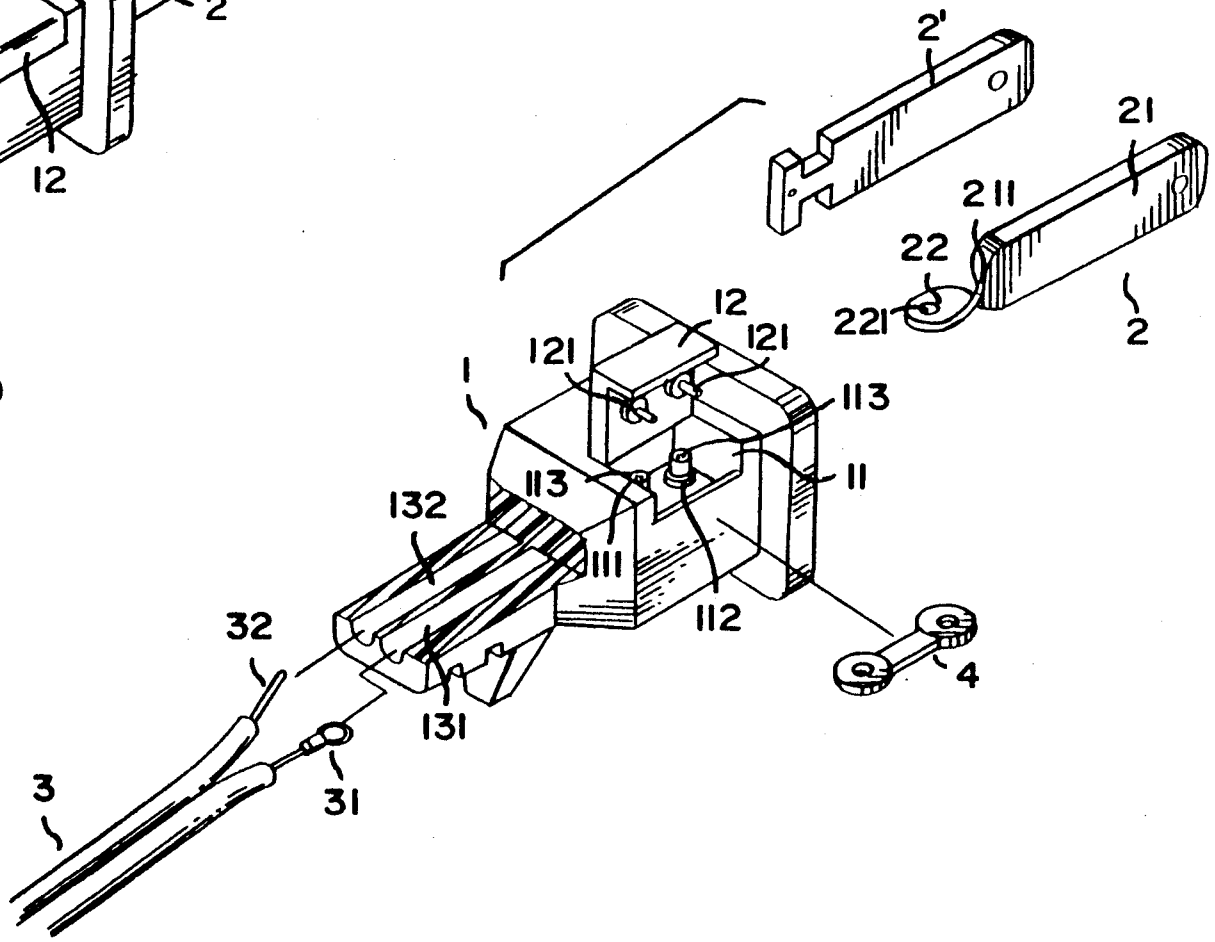
FIG. 2 is an exploded perspective view of a safety plug embodying the present invention.

Referring to FIG. 2, the plastic casing 1 of the safety plug of the present invention comprises a chamber 11 on a top edge thereof covered by a cover 12. Two female projections 111, 112 are made inside the chamber 11 at suitable locations of which each has a hole 113 through its central axis. The cover 12 has two male projections 121 on a bottom edge thereof at locations corresponding to the female projections 111, 112. The plastic casing 1 of the safety plug further comprises two separate wire holes 131, 132 for inserting the positive conductor 31 and the negative conductor 32 of an electric wire 3. Two plug pins, namely, the positive plug pin 2 and the negative plug pin 2' are respectively fastened in two holes (not shown) on the plastic casing 1. The positive plug pin 2 has a flat connecting end 22 at one end connected to the body 21 thereof through a neck 211. The flat connecting end 22 has a hole 221 thereon for connection to the female projection 112 and is twisted into such a position longitudinally aligned with and perpendicular to the body 21 for convenient installation. The negative plug pin 2' is directly connected to the negative conductor 32 of the electric wire 3, while the positive plug pin pole 2 is connected to the female projection 112. The positive conductor 31 of the electric wire 3 is connected to the female projection 111 which is connected to the female projection 112 by a fuse 4, and therefore, the positive plug pin 2 is connected to the positive conductor 31 of the electric wire 3 by the fuse 4.

Figure 1:
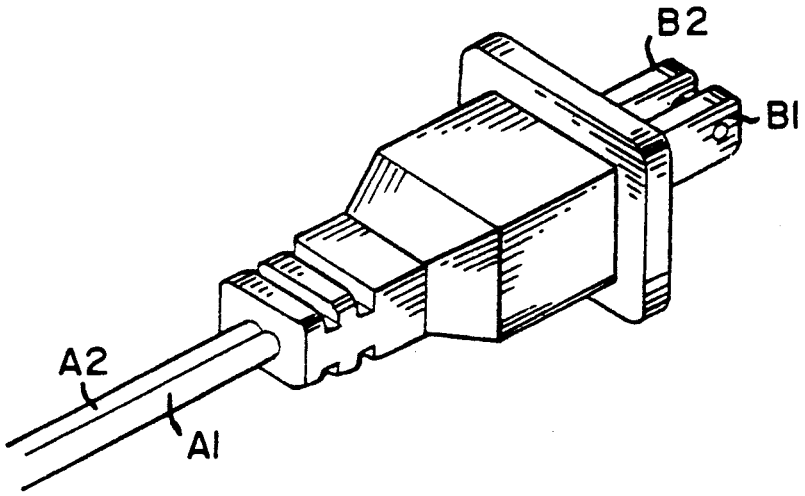
FIG. 1 is an elevation of a prior art electrical plug.
Figure 4:
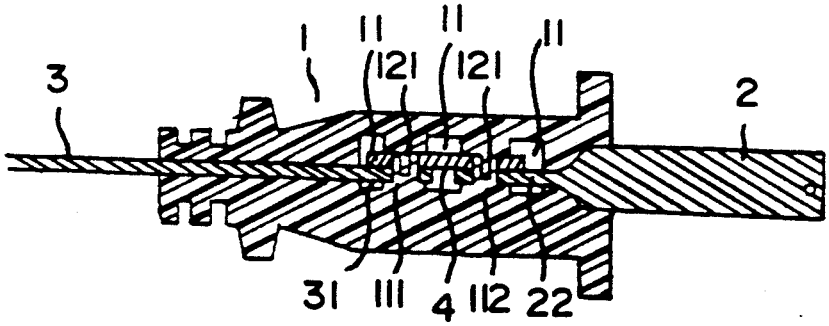
FIG. 4 is a sectional side view of the safety plug of the present invention.
Figure 3:
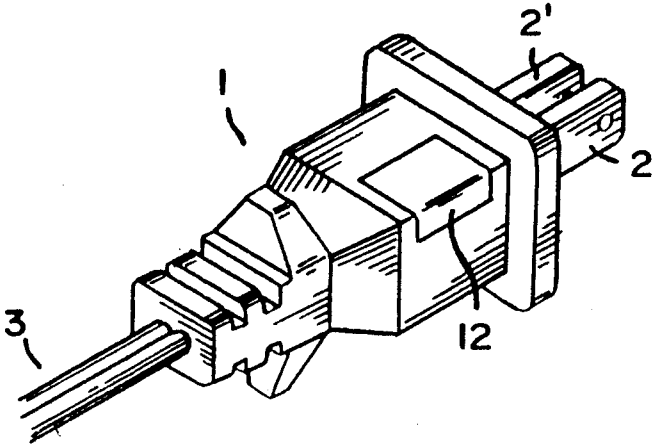
FIG. 3 is an elevation of the safety plug of the present invention.

After the assembly of the aforesaid parts, the cover 12 is covered on the chamber 11 with the male projections 121 respectively inserted into the holes 113 on the female projections 111, 112 (see FIGS. 3 and 4). If the electric wire 3 is overloaded, the fuse 4 will be burnt out to cut off the circuit, and therefore, the electric appliance in use is protected.

Because of the arrangement of the cover 12, the fuse 4 can be replaced easily after damage. Because the connecting end 22 is disposed perpendicular to the body 21 of the positive plug pin 2, the positive plug pin 2 can be conveniently mounted on the female projection 112. Further, because of two separate wire holes 131, 132 are provided for inserting the positive and negative conductors 31, 32 of the electric wire 3, the electric wire 3 can be conveniently connected to the positive and negative plug pins and firmly retained in place.

I claim:

1. A safety plug of the type having a plastic casing with positive and negative plug pins connected to the positive and negative conductors of an electric wire, and characterized in that said plastic casing comprises a chamber on a top edge thereof covered by a cover, and two separate wire holes for inserting the positive and negative conductors of said electric wire, said chamber having a first female projection and a second female projection connected by a fuse, said cover having two male projections respectively inserted into holes on said first and second female projections to secure said fuse in place, the positive conductor of said electric wire being connected to said fist female projection, the positive plug pin being connected to said second female projection.

2. The safety plug of claim 1, wherein the positive plug pin has a flat connecting end at one end of the pin body thereof for connection to said second female projection, said flat connecting end being longitudinally aligned with and perpendicular to said pin body.

* * * * *